US005123339A

United States Patent [19]

Hetherington

[11] Patent Number: 5,123,339

[45] Date of Patent: Jun. 23, 1992

[54] COMPACTORS

[76] Inventor: Henry Hetherington, Unit 5, Station Road, Bakewell, Derbyshire, United Kingdom, DE4 1GE

[21] Appl. No.: 539,016

[22] Filed: Jun. 15, 1990

[30] Foreign Application Priority Data

Jun. 15, 1989 [GB] United Kingdom ..... 8913796

[51] Int. Cl.[5] ..... B30B 15/16; B30B 1/08

[52] U.S. Cl. ..... 100/52; 100/229 A; 100/233; 100/271

[58] Field of Search ..... 100/48, 50, 52, 99, 100/229 A, 233, 269 R, 270, 271

[56] References Cited

U.S. PATENT DOCUMENTS

| | | | |
|---|---|---|---|
| 1,852,507 | 4/1932 | Davis | 100/233 X |
| 2,171,235 | 8/1939 | Gates et al. | 100/233 X |
| 2,826,318 | 3/1958 | Beasley | 100/233 X |
| 3,691,944 | 9/1972 | Boyd | 100/233 X |
| 3,918,359 | 11/1975 | Hennells et al. | 100/52 |
| 4,073,228 | 2/1978 | Henzl | 100/52 |
| 4,130,054 | 12/1978 | Tashman | 100/52 |
| 4,896.593 | 1/1990 | Slusser | 100/233 X |

FOREIGN PATENT DOCUMENTS

| | | | |
|---|---|---|---|
| 2519931 | 10/1976 | Fed. Rep. of Germany | 100/233 |
| 2430905 | 3/1980 | France | 100/233 |
| 596980 | 3/1978 | Switzerland | 100/233 |
| 1588013 | 4/1981 | United Kingdom | 100/233 |

*Primary Examiner*—Harvey C. Hornsby
*Assistant Examiner*—Stephen F. Gerrity
*Attorney, Agent, or Firm*—W. Thad Adams, III

[57] ABSTRACT

A compactor which includes a framework 10 adapted for reception of an open-topped rubbish container 14, a compacting plate 16 pivotally mounted on the framework 10 about an axis 20 adjacent to and parallel to the rear upper edge 22 of the rubbish container 14 and two piston and cylinder devices 28, 34 operable to pivot the plate 16 towards and away from the container 14.

4 Claims, 1 Drawing Sheet

COMPACTORS

TECHNICAL FIELD AND BACKGROUND OF THE INVENTION

The present invention concerns improvements in or relating to compactors.

The use of compactors for reducing the volume of rubbish, garbage or trash is becoming widespread in domestic and commercial situations. Such compactors comprise a receptacle for rubbish into which there is arranged to descend a compacting plate which compresses the rubbish into a compact layer in the receptacle, the plate then being retracted to allow the admission of further rubbish.

As the compacting plate must exert a reasonable force on the rubbish the mechanism for moving the plate is relatively robust and, consequently, occupies a considerable space. Thus if the compactor has to fit in to a relatively small location, for example, beneath a counter or worktop, its free volume, that is the volume of the compactor not occupied by operating equipment and the rubbish receiving receptacle, in other words the volume of the machine available to accept rubbish to be compacted, is relatively small. This results in a reluctance to use the compactor as frequently as could be.

In an effort to overcome this disadvantage, in prior compactors the rubbish container has been moveably mounted so that it can slide out of the compactor away from the compacting plate to expose its open top for the reception of rubbish, the container thereafter being moved back into the compactor prior to operation of the compacting plate. This also gives rise to disadvantages. For example, in view of the forces experienced during a compacting operation, the apparatus enabling the container to be moved must be very robust otherwise it could be damaged.

SUMMARY OF THE INVENTION

It is an object of the present invention to obviate or mitigate these and other disadvantages.

According to the present invention there is provided a compactor including a framework adapted for reception of an open-topped rubbish container and a compacting plate pivotable mounted on the framework about an axis adjacent to and parallel with the rear upper edge of the rubbish container and means for pivoting said plate towards and away from the container.

Preferably said means comprise two hydraulic piston and cylinder devices.

The piston and cylinder devices may include a first device mounted between the framework and the free end of an arm assembly. The second device may be mounted between the compacting plate and the free end of said arm assembly. The arm assembly is pivotal at its other end about an axis spaced from the plate pivotal axis.

Preferably said first device has a cylinder diameter greater than the cylinder diameter of the second device. Preferably both said devices are double acting and each end of each cylinder is connected to a source of pressure fluid which may comprise a reservoir, motor and pump assembly.

Preferably first pressure sensing means are incorporated in a fluid line between the pressure fluid source and the piston and cylinder devices through which supply of fluid causes the compacting plate to move towards the container.

Preferably second pressure sensing means are incorporated in another fluid line between the pressure source and the piston and cylinder devices through which supply of fluid causes the compacting plate to move away from the container.

Preferably said pressure sensing means operate a solenoid valve to cut-off the supply of fluid to the piston and cylinder device on detecting a predetermined pressure. The solenoid valve on detecting a signal from said first pressure sensing means may also divert fluid to the side of the piston and cylinder device opposite to that which was originally supplied to cause the compacting plate to move away from the container.

Preferably a micro-switch operated by a cam rotating with the compacting plate causes movement of the plate to stop when the container is full.

BRIEF DESCRIPTION OF THE DRAWINGS

An embodiment of the present invention will now be described by way of example only with reference to the accompanying drawings in which.

DESCRIPTION OF THE PREFERRED EMBODIMENT AND BEST MODE

A compactor comprises a framework 10 which supports at its base 12 an open-topped removable rectangular rubbish container 14, preferably manufactured from plastics material.

Figure 1:
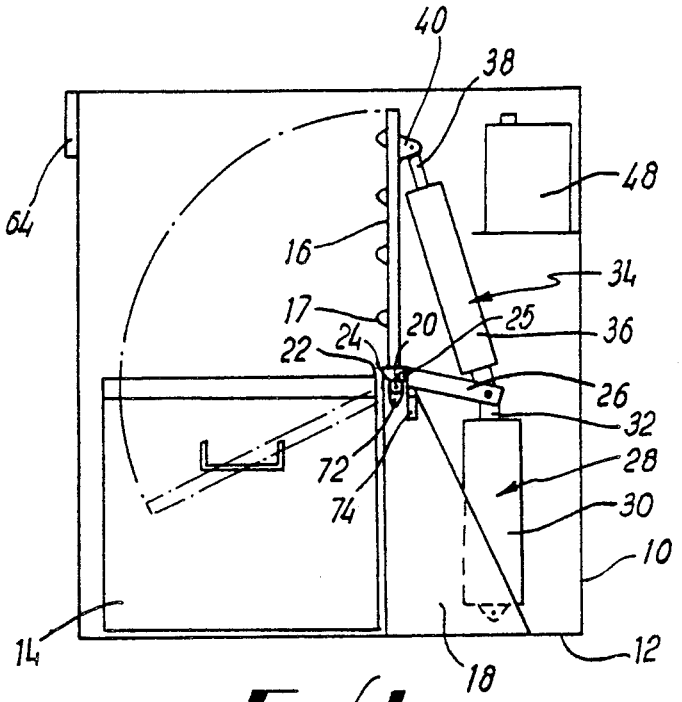
FIG. 1 shows a diagrammatic side elevation of a compactor.

A compacting plate 16 is pivotedly mounted on a sub-frame 18 about an axis 20 which is adjacent to and parallel with the top rear edge 22 of the container 14 so that it can pivot away from its substantially vertical rest position towards the container to the position within the container shown in chain lines in FIG. 1, to compact rubbish placed therein. The compacting plate 16 is mounted on a shaft 24 which is journalled in the sub-frame 18 and a pair of spaced apart arms 26 are rotatably mounted on the sub-frame 18, about a further shaft 25 spaced above and behind the shaft 24. The plate has ribs 17 on its underface which extend parallel to the axis of the shaft 24.

A first double acting hydraulic ram 28 has a cylinder 30 pivotably mounted to the framework and its piston 32 pivotably mounted to the free end of said arms 26. A second double acting hydraulic ram 34, having a cylinder diameter less than that of the first ram, has its cylinder 36 pivotedly mounted on the free end of the arms 26 and its piston 38 pivotably mounted to a bracket 40 on the top of the compacting plate 16.

By supplying hydraulic fluid to the first ram 28 on the side of its piston 31 remote from the piston rod 32, the piston and its rod move out of the cylinder 30 to cause the arms 26 to pivot towards the compacting plate 16 thereby causing initial pivotal movement of the plate towards the container 14. Supply of hydraulic fluid to the corresponding end 37 of the second ram 34 causes its piston 38 to advance thereby resulting in further pivotal movement of the compacting plate 16 towards and into the container 14. The supply of hydraulic fluid to the other side of the pistons of both rams causes reverse movement of the pistons and piston rods and corresponding reverse pivotal movement of the compacting plate out of and away from the container.

Figure 2:
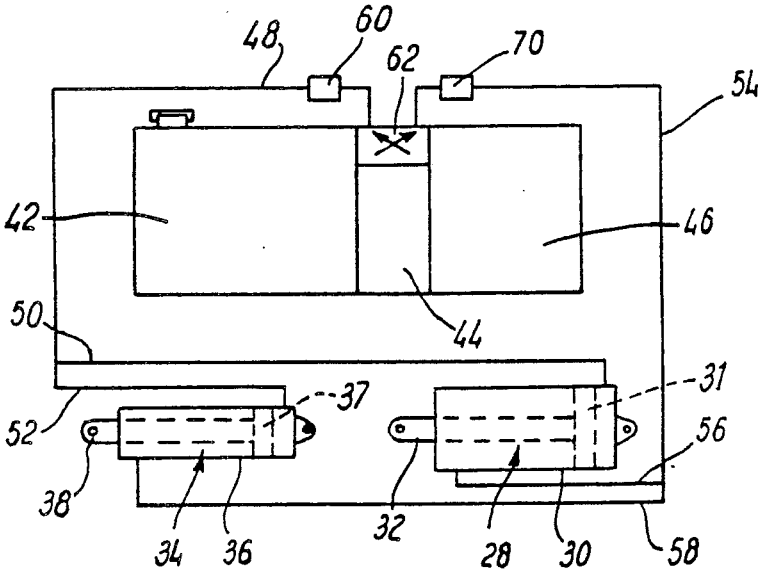
FIG. 2 shows a circuit diagram of the hydraulic supply within the compactor.

FIG. 2 shows a hydraulic circuit diagram. A pressure source comprises a reservoir 42, a pump 44 and an electric motor 46 for driving the pump. Conveniently, the pressure source is mounted on the framework in the space behind the plate 16 when it occupies its vertical position thereby maintaining compact overall dimensions for the compactor. A first pressure outlet 48 from the pump splits into two branches leading to each hydraulic ram on the side of the pistons 31, 37 thereof remote from the piston rods 32, 38. A secound outlet from the pump splits into two branches, each leading to a ram on the other side of the pistons. A pressure sensor 60 is connected into the first line 48 upstream of its branch and is connected to a solenoid operated valve 62 within the pump body, the valve determining the direction of flow of fluid through the respective lines.

In operation a cabinet door (not shown) mounted to the framework is opened by the user who tips rubbish into the container 14, this action being effectively unrestricted as the compacting plate is pivoted back to the vertical position towards the back of the container. The cabinet door is then closed and a start button on the cabinet front panel 64 is pressed to start the motor and pump which supplies fluid by way of the first line 48 and branches 50, 52 to the rams. As a result of the increased diameter of the first ram 28 when compared with the second ram, its piston 31 moves to pivot the arms 26 about the shaft 25 and causes partial pivotal movement of the compacting plate towards the container. When the piston 31 of the first ram 28 has reached the end of its travel or during this travel, the piston 37 of the second ram 34 advances, further pivoting the plate towards and, if necessary, into the container. During this operation the fluid exhausted from the other sides of the pistons flows through the second line 54 back to the reservoir 42 by way of the valve 62. When the pressure sensor 70 in the line 54 senses a predetermined maximum pressure corresponding to full compaction of rubbish in the container or maximum travel of the pistons, it passes a signal to the valve 62 which reverses the supply of pressure fluid to the rams through the second line 54 and braches 56, 58 and exhaust fluid from the rams through the first line, thereby causing the reversal of the pivotable movement of the compacting plate until it comes to its rest position at which point a second presssure sensor 60 in the second line senses a pressure build up and shuts off the electrical supply to the motor to render the apparatus inoperative until the start button is depressed again at which stage the cycle of operations described above is repeated.

A cam 72 is mounted on the axis 20 to rotate with the compacting plate. It operates a micro-switch 74 mounted on the framework until the compacting plate has pivoted beyond a predetermined position relative to the container. The micro-switch position, together with the pressure sensed by the sensor 60 can then be utilised to signal when the container has been filled with compacted rubbish to a predetermined level at which stage the compactor is de-activated until the container is emptied and replaced.

Various modifications can be made without departing from the scope of the invention, for example the container 14 need not be rectangular although a container of this shape gives the optimum rubbish capacity. The means for pivoting the compacting plate may be modified but the means described above have been found to be most satisfactory as they require a minimum amount of space whilst creating sufficient force and full travel of the compactor plate. Clearly, electro-mechanical plate moving means could be employed.

I claim:

1. A compactor, comprising:

(a) a framework;

(b) an open topped rubbish container having a rear upper edge and adapted for reception within the framework;

(c) first and second axes adjacent to and parallel with the rear upper edge;

(d) a compacting plate pivotally mounted on the framework about the first axis and movable from a position out of the container to a position within the container to compact rubbish therein;

(e) an arm pivotally mounted on the framework about said second axis and extending away from the container;

(f) a first hydraulic piston and cylinder device mounted between the framework and a point on the arm spaced from the second axis;

(g) a second hydraulic piston and cylinder device mounted between a point on the arm spaced from the second axis and the compacting plate;

(h) first and second hydraulic branches for supplying and exhausting fluid to and from said first device;

(i) third and fourth hydraulic branches for supplying and exhausting fluid to and from said second device;

(j) a source of pressurized fluid to which said first and third and second and fourth hydraulic branches are selectively connectable;

(k) valve means for effecting said selective connection;

a first fluid line provided between the first and third branches and the valve means;

(l) a second fluid line provided between the second and fourth branches and the valve means, first and second pressure sensors incorporated in said first and second lines respectively;

(m) valve operating means connected to the valve means and responsive to the first and second pressure sensors to direct pressure fluid to the first and second lines to cause the compacting plate to move towards and into and out of and away from the container;

(n) a cam mounted about said first axis and movable with the compacting plate; and (o) a micro-switch mounted on the framework and operable by the cam to emit a signal up to the point that the plate reaches the container full position, a signal emitted by a pressure sensor prior to said position being reached indicating that the contents of the container have exceeded a predetermined level.

2. A compactor according to claim 1, wherein said first axis is spaced from said second axis.

3. A compactor according to claim 1, wherein the cylinder of the first piston and cylinder device has a diameter greater than the cylinder of the second piston and cylinder device.

4. A compactor, comprising:

(a) a framework;

an open topped rubbish container having a rear upper edge and adapted for reception within the framework;

(b) first and second axes adjacent to and parallel with the rear upper edge;

(c) a compacting plate pivotally mounted on the framework about said first axis and movable from a position out of the container to a position within the container to compact rubbish therein;

(d) a cam mounted on said first axis and movable with the compacting plate;

(e) a micro-switch mounted on the framework, engagable by the cam and adapted to emit a signal until the plate has reached a predetermined position within the container where the container is full;

(f) an arm pivotally mounted on the framework about the second axis and extending away from the container;

(g) a first hydraulic piston and cylinder device mounted between the framework at a point on the arm spaced from the second axis;

(h) a second hydraulic piston and cylinder device mounted between a point on the arm spaced from the second axis and the compacting plate;

(i) a source of pressure fluid;

(j) valve means for the source of fluid pressure;

(k) first and second hydraulic lines connected between the valve means and both piston and cylinder devices to convey fluid to and from the piston and cylinder devices dependent upon the position of the valve means; and (l) first and second pressure sensors incorporated in said first and second hydraulic lines respectively and connectable with the valve means to control the operation thereof in response to action of the cam relative on the micro-switch.

* * * * *